United States Patent [19]

Watanabe

[11] 4,004,383

[45] Jan. 25, 1977

[54] METHOD AND DEVICE FOR ANCHORING A STRUT

[76] Inventor: Tsuguhiko Watanabe, No. 5-13, 1-chome, Ehara-cho, Nakano, Tokyo, Japan

[22] Filed: Sept. 12, 1975

[21] Appl. No.: 612,683

[30] Foreign Application Priority Data

| | | |
|---|---|---|
| Nov. 8, 1974 | Japan | 49-128106 |
| May 19, 1975 | Japan | 50-65922[U] |
| July 29, 1975 | Japan | 50-104165[U] |

[52] U.S. Cl. ..... 52/154; 52/165; 52/298; 52/742

[51] Int. Cl.[2] ..... E04H 12/20; E04H 17/22

[58] Field of Search ..... 52/298, 154, 165, 155, 52/742; 248/44, 48, 156

[56] References Cited

UNITED STATES PATENTS

| | | | |
|---|---|---|---|
| 204,565 | 6/1878 | Hartley et al. | 52/154 X |
| 519,445 | 5/1894 | Cooper | 52/298 X |
| 632,966 | 9/1899 | Mullenix | 52/156 X |
| 816,719 | 4/1906 | Fell | 52/297 |
| 1,361,345 | 12/1920 | Ness et al. | 52/165 |
| 2,908,461 | 10/1959 | Coffeen | 248/44 |

FOREIGN PATENTS OR APPLICATIONS

| | | | |
|---|---|---|---|
| 571,895 | 2/1924 | France | 52/297 |
| 293,916 | 9/1916 | Germany | 52/298 |
| 18,768 | 1907 | United Kingdom | 52/297 |

*Primary Examiner*—Alfred C. Perham
*Attorney, Agent, or Firm*—Saul Jecies

[57] ABSTRACT

A method and device for anchoring a strut such as a stockade, ground mark or guardrail to the ground, in which a top plate is formed with a bore for accomodating the strut, and radial plates are secured to the bottom of the top plate. The radial plates radially extend outward from the center of the bore of the top plate and have a cut-out portion to support the strut. The bore of the top plate is sized to be larger in diameter than the strut so that the strut can be orientated within a given range. A plurality of clamping means are provided on the top plate and adapted to radially urge the strut thereby to determine the orientation of the strut relative to the center of the bore of the top plate. A strut anchoring device thus constructed is placed on the ground which is slightly digged and driven into the ground by driving a driving pope or tool abutting against a bearing surface provided in the radial plates until the top plate reaches the ground surface. Thereafter, the driving pope is pulled out of the device and the strut is inserted into a cavity defined by the driving pope until the lower end of the strut abuts against the bearing surface of the radial plates. Subsequently, the orientation of the strut with respect to the center of the bore of the top plate is adjusted by adjusting the clamping means provided on the top plate. To increase the resisting strength of the radial plates, a desired number of reinforcing or stabilizing plates are provided which are adapted to be driven into the ground through bores formed in the top plate at suitable locations.

5 Claims, 10 Drawing Figures

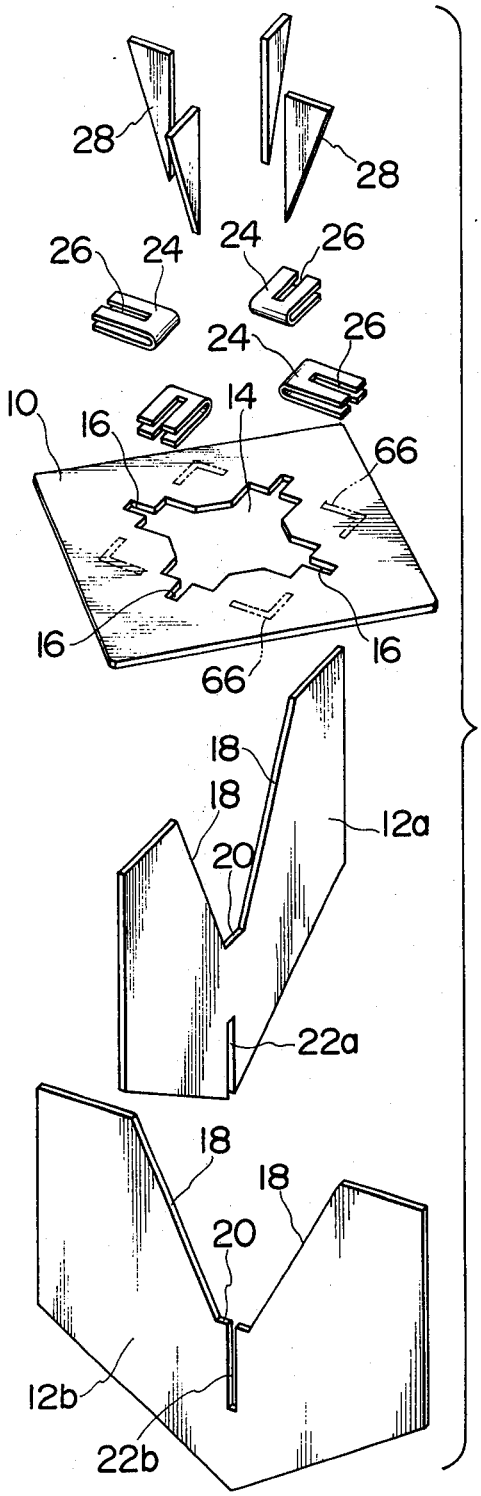
FIG. 1
FIG. 2
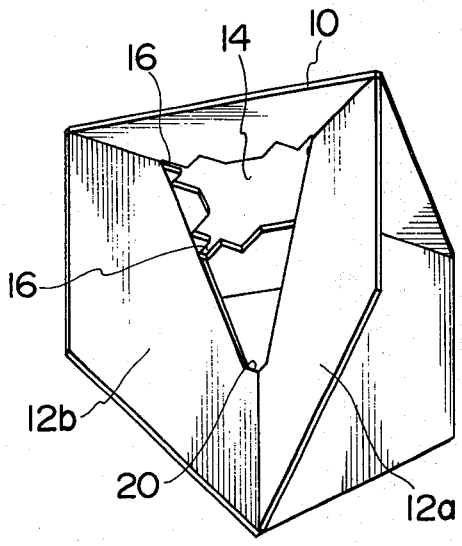
FIG. 3
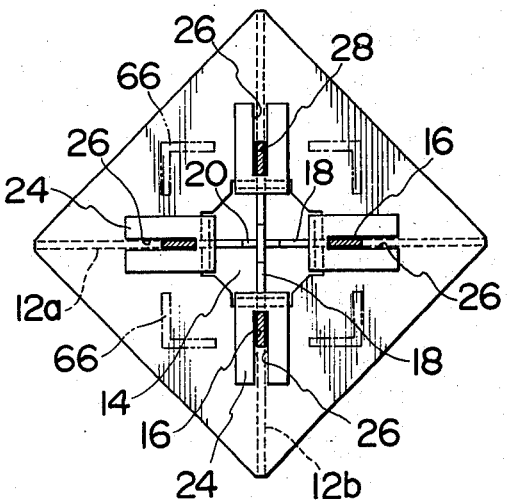

METHOD AND DEVICE FOR ANCHORING A STRUT

BACKGROUND OF THE INVENTION

The present invention relates to a method and device for anchoring struts of articles standing on the ground such as a stockade, ground mark or guardrail to the ground.

As is well known in the art, various attempts have heretofore been made to effect anchoring of the struts to the ground. Typical one of these prior expedients is to dig the ground to a predetermined depth and thereafter inserting a lower portion of the strut provided with a crossing anchoring pin whereupon small rocks and sand are rammed into the bore. Another prior expedient is to bury a concrete-block formed with a bore into which the strut is inserted and supported thereby.

In the prior art expedients, it is necessarily required to dig the ground to a depth of about 60 cm to form a bore for accomodating the strut. This step is usually performed by hands which are inefficient and need many hours. Another drawback encountered with the former expedient resides in the fact that the small rocks and sand are required in a larger amount resulting in the increase in the cost for completing the anchoring of the strut to the ground. A drawback is also encountered in the latter expedient in that a relatively larger bore should be formed in order to accomodate the concrete-block and, since a relatively larger gap exists between the periphery of the concrete-block and the bore, it is necessary to fill up the gap to fixedly support the concrete-block in the ground. This is reflected by difficulty in manipulation of the concrete-block having the larger weight and the increase in the carriage so that the final cost for performing anchoring of the strut is considerably increased.

In order to overcome these drawbacks encountered in the prior art expedients, it has heretofore been proposed to provide a supporting pipe formed with a bore having a diameter to tightly accomodate the strut and provided at its outer periphery with various supporting means. The supporting pipe is normally driven into the ground by some driving means and, thereafter, the strut is tightly fitted into the bore formed in the pipe. This expedient is, however, disadvantageous in that it is difficult to drive the pipe into the ground at a given angle due to obstacles such as small rocks contained in the ground and the pipe is finally driven into the ground in a displaced condition. If the supporting pipe is inserted into the bore of the ground in the displaced condition, the struts supported by the pipes displaced in the ground can not be aligned with each other and become impractical.

SUMMARY OF THE INVENTION

It is therefore an object of the present invention to provide a method and device for anchoring a strut in the ground in a highly efficient manner.

It is another object of the present invention to provide an improved anchoring device for carrying a method for anchoring the strut in the ground.

It is another object of the present invention to provide an improved anchoring device having a reinforced structure to resist the reaction encountered by the ground during driving of the anchoring device.

It is still another object of the present invention to provide an improved anchoring device for the strut which is simple in construction and easy to transfer.

In order to achieve these objects, the present invention contemplates to provide an anchoring device which is comprised of a top plate formed at its central portion with a bore having a diameter larger than that of the strut to be supported, and a plurality of radial plates disposed below the top plate in diagonal relationship with respect to each other and formed with cut-out portions respectively for accomodating the strut. The anchoring device is further comprised of a plurality of clamping devices or members which radially extend at equal angles on the top plate for clamping the strut firmly on the top plate. The anchoring device thus constructed is driven into the ground by some suitable driving means at a location in which the strut is to be supported until the top plate is aligned with the ground surface. Thereafter, the driving means is moved out of the bore of the top plate and the strut is inserted into the bore and cut-out portions of the radial plates. In this manner, the strut engages with the cut-out portions of the radial plates at its lower portion and, subsequently, the strut is urged in different directions by the clamping members while adjusting the orientation of the strut appearing above the ground surface and finally clamped to be supported by the clamping members.

The anchoring device may further include a plurality of stabilizing plates serving as reinforcing members which may be inserted into recessed portions formed in the top plate and forcedly driven downward thereinto so that the anchoring device is firmly fixed in the ground thereby to gradually increase the resisting strength of the device.

With the arrangement mentioned hereinabove, the sinking of the anchoring device is satisfactorily prevented by the top plate and the falling of the device is also prevented by the actions of the radial plates whereby the device is firmly fixed in the ground. If desired, the stabilizing plates are driven into the recessed portions of the top plate so that the anchoring device is more firmly fixed in the ground. If, for example, the anchoring device is fallen during driving of the device, it is possible to adjust the orientation of the device by driving some of the stabilizing plates into the recessed portions of the top plate. If, further, it is desired to stand the strut at a given orientation, some of the stabilizing plates are inserted into desired ones of the recessed portions of the top plate. Thus, the orientation of the strut may be varied in an arbitrary manner. Since, furthermore, the component parts of the anchoring device may be formed with plate members, the anchoring device is light in weight and easy to transfer to a suitable destination. This is also reflected by the decrease in the manufacturing and manipulating costs.

These and other objects, features and advantages of the present invention will become more apparent from the following description when taken in conjunction with the accompanying drawings.

BRIEF DESCRIPTION OF THE DRAWINGS

FIG. 1 is an exploded perspective view illustrating a preferred embodiment of a strut anchoring device according to the present invention;

FIG. 2 is a perspective view of the strut anchoring device which is shown in assembled condition;

FIG. 3 is a plan view of the strut anchoring device shown in FIG. 2;

DESCRIPTION OF THE PREFERRED EMBODIMENTS

Figure 4:
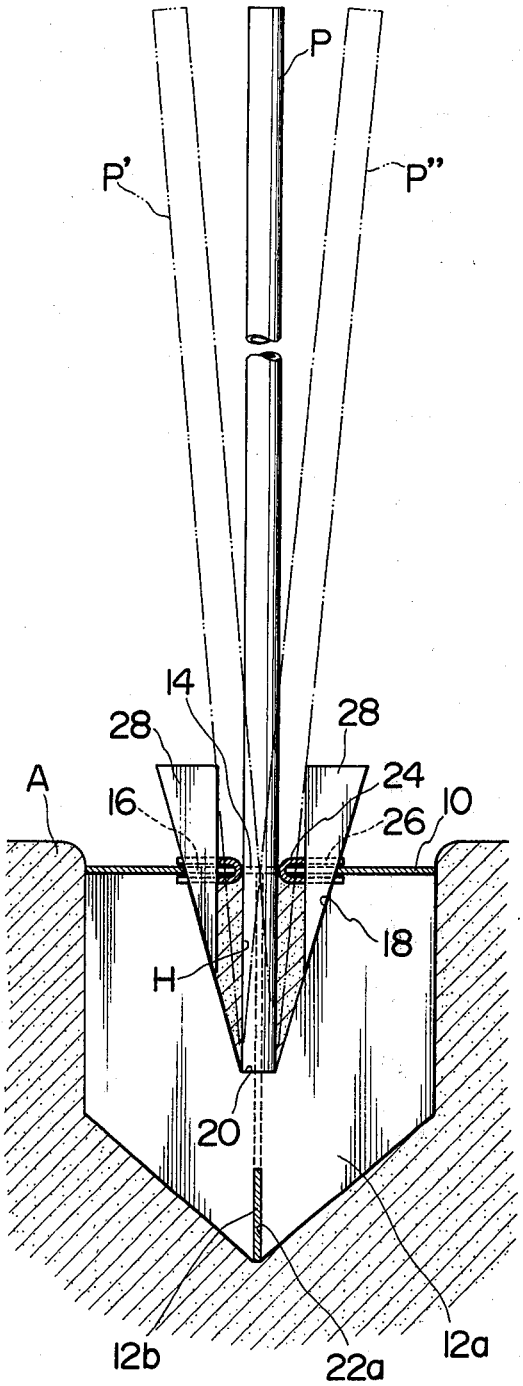
FIG. 4 is a longitudinal sectional view of the strut anchoring device by which the strut is supported.

Referring now to FIGS. 1 to 4 of the accompanying drawings, there is shown a preferred embodiment of the strut anchoring device according to the present invention. As shown, the strut anchoring device is comprised of a top plate 10 formed in a rectangular shape, and radial plates 12*a* and 12*b* attached to the bottom surface of the top plate 10 by some suitable known means such as welding. The top plate 10 is formed at its central portion with a bore 14 in a rectangular shape providing a space larger than that defined by the diameter of the strut P for accomodating the same, and a plurality of recessed portions 16 contiguous with the bore 14 and diagonally extending relative to each other. As best shown in FIG. 1, each of the radial plates 12*a* and 12*b* attached to the top plate 10 is formed with a cut-out or clamping portion 18 at its central portion and a bearing surface 20. The radial plates 12*a* and 12*b* are provided with sharp edges, respectively, and have longitudinally extending slots 22*a* and 22*b*, respectively, by which the radial plates 12*a* and 12*b* are fixed to each other in crossed relationship.

Indicated as at 24 is a clamping ring which is formed in U-shape in cross section. The clamping ring 24 is inserted into the bore 14 such that the top plate 10 is disposed in the U-shape portion of the clamping ring 24. The clamping ring 24 has elongated slots 26 formed at the central portion of the ring 24 and corresponding to the slot 16 in the top plate 10. After the clamping ring 24 is disposed in the bore 14 of the top plate 10, the position of the clamping ring 24 is adjusted so that the elongated slots 26 of the clamping ring 24 and the corresponding slot 16 of the top plate 10 are aligned with one another. Thereafter, a wedge member 28 in the form of a triangular shape is inserted through the slots 26 and 16, so that the clamping ring 24 is radially moved inward by the action of the wedge member 28 engaging with the clamping surface 18 of the radial plate 12*a* or 12*b*.

It is to be noted that while the top plate 10 is shown as having a rectangular shape the top plate 10 may be formed into a triangular shape. It is also to be noted that the radial plates are arranged to radially extend or expand outward in three equally angled directions if desired.

Figure 5:
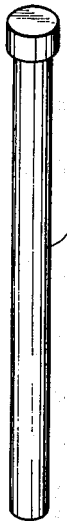
FIG. 5 is a perspective view showing an example of a driving tool.

FIG. 5 shows a preferred example of a driving tool 30 for driving the trust anchoring device mentioned hereinabove. The driving tool 30 is constituted by a rounded bar which is adapted to engage at its lower end with the bearing surfaces 20 formed in the radial plates 12*a* and 12*b* and has a suitable length.

The strut anchoring device thus constructed is driven into the ground by driving tool 30 bearing against the bearing surfaces 20 of the radial plates 12*a* and 12*b* after the ground has been slightly digged. The driving operation of the driving tool 30 is continued until the top plate 10 of the strut anchoring device reaches the ground surface. After the driving operation has been completed, the driving tool 30 is pulled out of the strut anchoring device and, thus, a cavity H is formed along the central portion of the radial plates 12*a* and 12*b*.

Subsequently, the strut P is inserted into the cavity H in a manner as shown in FIG. 4 until the lower end of the strut abuts against the bearing surfaces 20 of the radial plates 12*a* and 12*b*. Thereafter, the wedge members 28 are inserted through the slots of the clamping rings 24 and forced downward thereby moving the clamping rings 24 radially inward for thereby firmly anchoring the strut P against the anchoring device.

The wedge members 28 appearing on the ground surface present various troubles so that it is preferable to bend the wedge members 28 above the clamping rings 24 and scrap off the wedge members 28 whereupon the top plate 10 and the clamping rings 24 are concealed by the soil.

Figure 6:
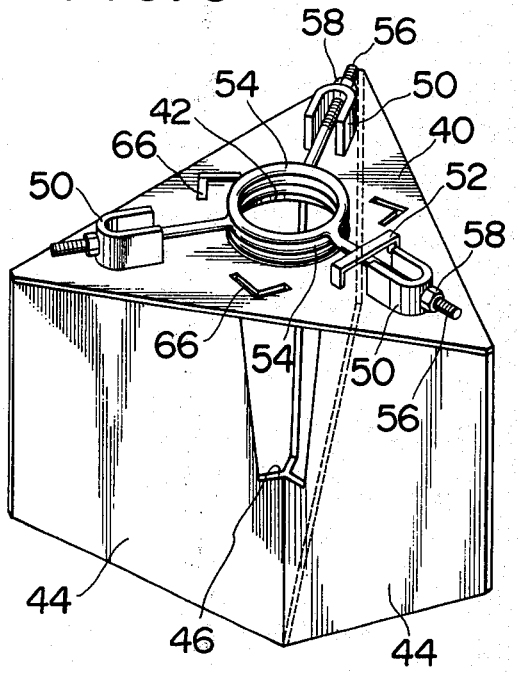
FIG. 6 is a perspective view of another preferred embodiment of the strut anchoring device according to the present invention.
Figure 7:
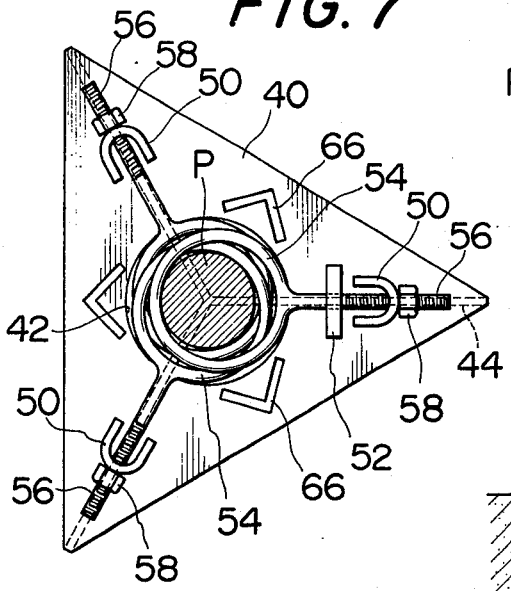
FIG. 7 is a plan view of the device shown in FIG. 6.
Figure 8:
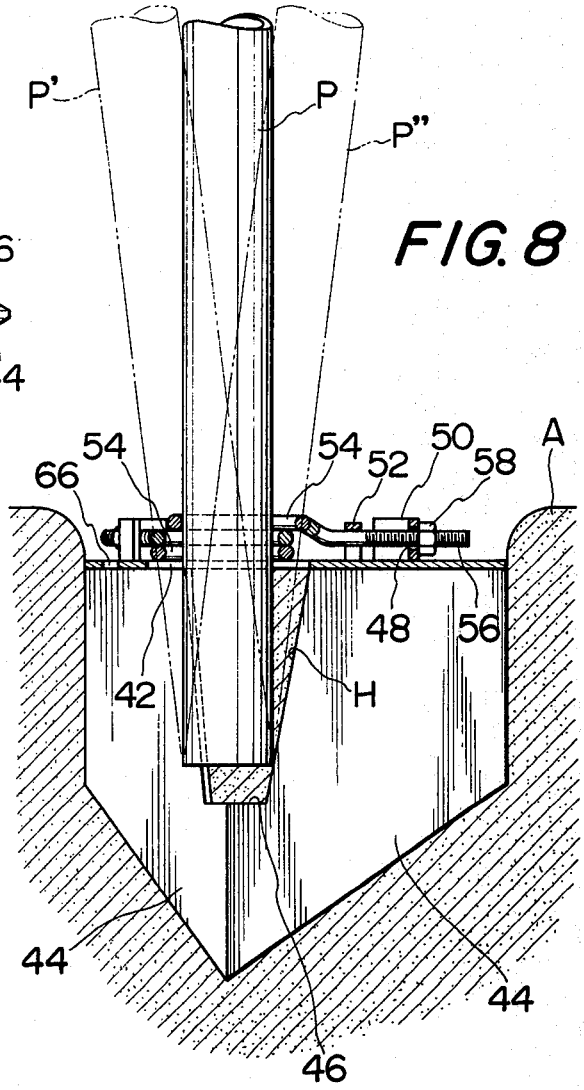
FIG. 8 is a sectional view of the strut anchoring device by which the strut is supported.

FIGS. 6 through 8 illustrate another preferred embodiment of the strut anchoring device embodying the present invention. In this illustrated embodiment, the strut anchoring device includes a top plate 40 having at its central portion a bore 42 which is larger in diameter than the strut P, and radial plates 44 and 45 which are diagonally arranged to radially extend toward apecies of the top plate 40 and have wedge-shaped lower portions, respectively. The conjunction between the radial plates 44 and 45 is cut-out to form a bearing surface 46 for the strut.

A plurality of fixed rings 50 are provided on the top plate 40 and equally angularly displaced from each other, each having an oval bore 48 formed therein. A regulating member 52 is arbitrarily secured to the top plate 40 between the bore 42 and the fixed ring 50.

A plurality of clamping rings 54 are provided for clamping the strut P and each has a ring portion which is slightly larger in diameter than the strut and a threaded portion 56 which is screwed into the nut 58 bearing against the fixed ring 50. As best shown in FIG. 6, the ring portions of the clamping rings 54 are arranged to be disposed on the top plate 40 such that the uppermost clamping ring 54 has its threaded portion 56 inserted through the regulating member 52 into the oval bore 48 of the fixed ring 50 whereby the ring portions of each of the clamping rings 54 are vertically aligned with each other.

It should be noted in this instance that the top plate 40 may have any desired shape such as a rectangular shape and the radial plates 44 and 45 and the clamping rings 54 are disposed in diagonal relationship with respect to each other.

The strut anchoring device thus constructed is initially placed on the ground which is slightly digged as shown in FIG. 8. Then, the clamping rings 54 are aligned with each other by releasing the nuts 58. Subsequently, the driving strut or tool 30 is disposed into the anchoring device until the lower end thereof abuts against the bearing surface 46 of the radial plates 44 and 45 and driven with the anchoring device until the top plate 40 reaches the ground surface. After the driving operation has been completed, the driving tool 30 is pulled upward thereby forming a cavity H as shown in FIG. 8. The strut P is inserted through the cavity H until the lower end thereof abuts against the bearing surface 46 of the radial plates 44 and 45. Thereafter, the nuts 58 are rotated in the direction to cause the ring portions of the clamping rings 54 to move radially outward. In this manner, the strut P is firmly clamped to the anchoring device and is oriented within a range P′ to P″ defined by the diameter of the bore 42 of the top plate by adjusting the nuts 58 associated with the clamping rings 54. It is to be understood in this instance that each of the clamping rings 54 is prevented from floating by the action of the regulating member 52 with which the uppermost clamping ring 54 is associated.

Figure 9:
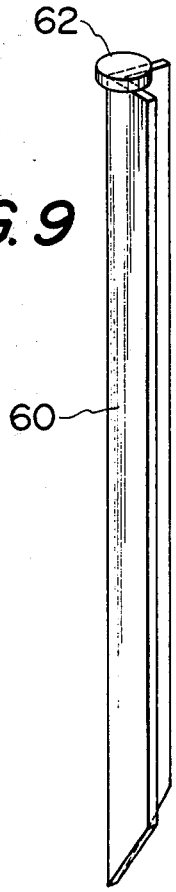
FIG. 9 is a perspective view showing an example of a stabilizing plate.
Figure 10:
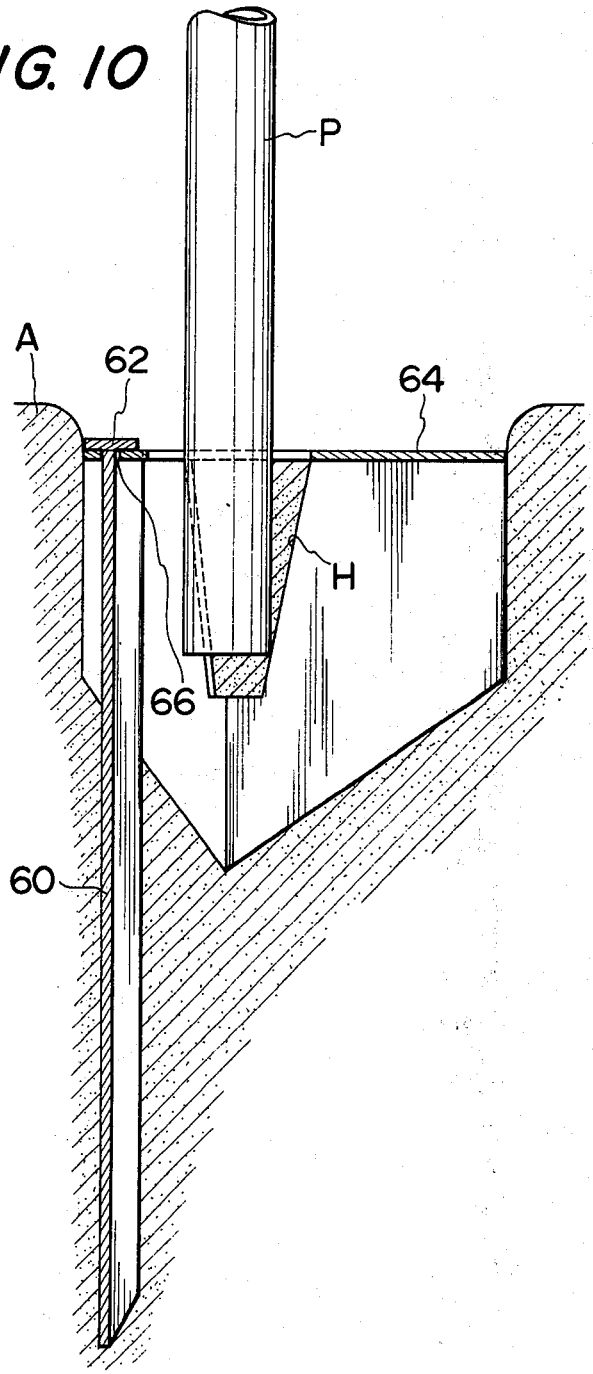
FIG. 10 is a sectional view of the strut anchoring device with the stabilizing plate driven into the ground.

FIGS. 9 and 10 shown a preferred example of a reinforcing structure for use in the strut anchoring device according to the present invention. As shown, the reinforcing structure is comprised of a stabilizing plate 60 having L-shape in cross section as shown in FIG. 9. The stabilizing plate 60 has a wedge-shaped end and has a suitable length according to the size of the strut anchoring device. Indicated at 62 is a head which is provided on top of the stabilizing plate 60 and adapted to engage with the upper face of the top plate 64. The top plate 64 may be formed with a plurality of bores 66 which are L-shaped in cross section to accomodate the stabilizing plates 60, respectively. The desired number of stabilizing plates 60 are driven into the ground through the associated bore 66 formed in the top plate 64 thereby stepwisely increasing the resisting surface area of the strut anchoring device.

As mentioned hereinabove, since the strut anchoring device of the present invention is driven into the ground after the ground surface A is digged in a slight amount by driving the radial plates into the ground through the use of the driving tool 30, the strut anchoring device can be easily burried into the ground by a single step of driving. Moreover, since the radial plates are adapted to bear against the side pressures encountered by the soil while the top plate is adapted to bear against the vertical pressure, the strut anchoring device is maintained in a given position in a satisfactorily fashion. If, furthermore, the strut anchoring device can not be driven into the ground in a predetermined orientation, the wedge members 28 or the clamping rings 54 forming the clamping means are adjusted to correctly stand the strut P at a given arbitrary angle.

In addition, the top plate forming part of the anchoring device may be formed with a plurality of bores for accomodating the stabilizing members 60, by which the strut anchoring device is more firmly fixed in the ground in a simple and reliable manner.

While the strut anchoring device of the present invention has been described as including the top plate having a rectangular or triangular shape as a preferred example, it should be noted that the top plate may have any desired shape other than rectangular and triangular shapes. Further, the number of radial plates and the clamping means may also be varied so as to meet various requirements.

While the present invention has been shown and described with reference to particular embodiments, it should be noted that various changes or modifications may be made without departing from the scope of the present invention.

What is claimed is:

1. A method of anchoring a strut in the ground, comprising the steps of connecting upright radial plates to the underside of a top plate provided with a hole so that said upright radial plates provide bearing surfaces resisting against side and vertical pressures;

driving said radial plates into the ground at a given location until said top plate engages and compacts the ground beneath it;

inserting the strut through the hole into the thus compacted ground until a lower end of the strut abuts against a bearing surface provided in the radial plates; and adjusting the strut to a desired angular orientation relative to the horizontal by engaging and exerting pressure upon the strut with respective circumferentially spaced clamping means associated with at least one of the top plate and the radial plates.

2. A strut anchoring device, comprising a top plate having a central portion provided with a hole which is substantially larger in diameter than a strut to be anchored;

a plurality of radial plates having upper ends secured to the underside of said top plate and having lower portions formed with sharp edges, said radial plates having a bearing surface against which a lower end of the strut is adapted to abut; and clamping means associated with one of said top plate and radial plates at locations circumferentially spaced about said hole and operative for engaging said strut so as to urge it to a desired angular orientation relative to said top plate and to the horizontal and for clamping the strut in position at said desired orientation.

3. A strut anchoring device according to claim 2, in which said radial plates are formed with clamping surfaces, and in which said clamping means comprises a plurality of clamping rings each having a U-shaped portion which is disposed in the hole of said top plate such that a portion of the top plate is interposed between said respective U-shaped portion, each of said clamping rings having elongated slots, and a plurality of wedge members which are inserted through the elongated slots of the respective clamping rings, said wedge members engaging with said clamping surfaces of said radial plates for thereby urging said wedge members radially inward to anchor the strut.

4. A strut anchoring device according to claim 2, in which said clamping means comprises a plurality of fixed rings provided on said top plate at circumferentially equally spaced positions, a plurality of clamping rings having ring portions which are larger in diameter than the strut, and threaded portions integral with the respective ring portions, and, which are respectively connected to said fixed rings by nuts, and a regulating member cooperating with one of said clamping rings for thereby preventing the floating of said clamping rings, said ring portions of said clamping rings being radially urged outward whereby the strut is firmly clamped to said top plate.

5. A strut anchoring device according to claim 2, in which said top plate is formed with a plurality of openings, and further comprising a plurality of stabilizing members which are inserted through said plurality of openings and adapted to be driven into the ground for thereby increasing the resisting strength of said radial plates.

* * * * *